US007198576B2

(12) United States Patent
Sullivan et al.

(10) Patent No.: US 7,198,576 B2
(45) Date of Patent: Apr. 3, 2007

(54) GOLF BALL COMPRISING UV-CURED NON-SURFACE LAYER

(75) Inventors: Michael J. Sullivan, Barrington, RI (US); Matthew F. Hogge, New Bedford, MA (US); Derek A. Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 106 days.

(21) Appl. No.: 10/462,681

(22) Filed: Jun. 17, 2003

(65) Prior Publication Data

US 2004/0259665 A1 Dec. 23, 2004

(51) Int. Cl.
*A63B 37/06* (2006.01)
*A63B 37/12* (2006.01)

(52) U.S. Cl. ..... 473/370; 473/373; 473/374

(58) Field of Classification Search ..... 473/351–378
See application file for complete search history.

(56) References Cited

U.S. PATENT DOCUMENTS

| | | | | |
|---|---|---|---|---|
| 3,872,349 | A | 3/1975 | Spero et al. | 315/39 |
| 3,983,039 | A | 9/1976 | Eastland | 250/492 R |
| 4,042,850 | A | 8/1977 | Ury et al. | 315/39 |
| 4,056,269 | A * | 11/1977 | Pollitt et al. | 473/372 |
| 4,076,255 | A * | 2/1978 | Moore et al. | 473/359 |
| 4,208,587 | A | 6/1980 | Eastlund et al. | 250/492 R |
| 4,264,075 | A * | 4/1981 | Miller et al. | 473/372 |
| 4,274,637 | A | 6/1981 | Molitor | 273/235 R |
| 4,313,969 | A | 2/1982 | Matthews et al. | 427/44 |
| 4,473,665 | A | 9/1984 | Martini-Vvedensky et al. | 521/79 |
| 4,485,332 | A | 11/1984 | Ury et al. | 315/112 |
| 4,501,993 | A | 2/1985 | Mueller et al. | 315/248 |
| 4,507,587 | A | 3/1985 | Wood et al. | 315/39 |
| 4,560,168 | A | 12/1985 | Aoyama | |
| 4,670,295 | A | 6/1987 | Quinn et al. | 427/54.1 |
| 4,680,368 | A * | 7/1987 | Nakamoto et al. | 528/49 |
| 4,751,102 | A * | 6/1988 | Adair et al. | 427/514 |
| 4,859,906 | A | 8/1989 | Ury et al. | 313/639 |
| 4,887,008 | A | 12/1989 | Wood | 315/39 |
| 4,925,193 | A | 5/1990 | Melvin et al. | |
| 4,960,281 | A | 10/1990 | Aoyama | |
| 4,998,734 | A * | 3/1991 | Meyer | 473/356 |
| 5,006,297 | A | 4/1991 | Brown et al. | 264/234 |
| 5,160,674 | A | 11/1992 | Colton et al. | 264/50 |
| 5,248,878 | A | 9/1993 | Ihara | 219/121.69 |
| 5,249,804 | A | 10/1993 | Sanchez | |

(Continued)

FOREIGN PATENT DOCUMENTS

| | | |
|---|---|---|
| WO | WO 99/37731 | 7/1999 |

OTHER PUBLICATIONS

U.S. Appl. No. 10/339,603, filed Jan. 10, 2003 entitled "Polyurethane Compositions for Golf Balls".

(Continued)

*Primary Examiner*—Eugene Kim
*Assistant Examiner*—Alvin A. Hunter, Jr.
(74) *Attorney, Agent, or Firm*—Bingham McCutchen LLP

(57) ABSTRACT

Golf balls including at least one non-surface layer that has been treated with a radiation source to effect a complete cure of the non-surface layer and methods for making same, wherein the radiation-curable non-surface layer includes a polymer component and, optionally, an initiator, a crosslinking agent, or both.

20 Claims, 2 Drawing Sheets

U.S. PATENT DOCUMENTS 5,300,331 A 4/1994 Schaeffer ..... 427/493
5,334,673 A 8/1994 Wu
5,395,862 A 3/1995 Neckers et al. ..... 522/25
5,440,137 A 8/1995 Sowers ..... 250/504 R
5,451,343 A 9/1995 Neckers et al. ..... 252/582
5,484,870 A 1/1996 Wu ..... 528/28
5,562,552 A 10/1996 Thurman ..... 473/379
5,575,477 A 11/1996 Hwang ..... 473/379
5,624,332 A 4/1997 Dalton et al. ..... 473/354
5,688,181 A 11/1997 Albert ..... 473/61
5,688,191 A 11/1997 Cavallaro et al. ..... 473/373
5,693,711 A * 12/1997 Akiba et al. ..... 525/93
5,713,801 A 2/1998 Aoyama ..... 473/354
5,733,428 A 3/1998 Calabria et al. ..... 264/134
5,779,561 A * 7/1998 Sullivan et al. ..... 473/373
5,803,831 A 9/1998 Sullivan et al. ..... 473/374
5,820,488 A 10/1998 Sullivan et al. ..... 473/374
5,827,134 A 10/1998 Sullivan et al. ..... 473/372
5,849,168 A 12/1998 Lutz ..... 264/755
5,885,172 A 3/1999 Hebert et al. ..... 473/354
5,919,100 A 7/1999 Boehm et al. ..... 473/354
5,922,252 A 7/1999 Stanton et al. ..... 264/4
5,925,715 A 7/1999 Mitra ..... 525/293
5,957,787 A 9/1999 Hwang ..... 473/379
5,965,669 A 10/1999 Cavallaro et al. ..... 525/221
5,981,654 A 11/1999 Rajagopalan ..... 525/66
5,981,658 A 11/1999 Rajagopalan et al. ..... 525/72
6,013,330 A 1/2000 Lutz ..... 427/511
6,056,842 A 5/2000 Dalton et al. ..... 156/243
6,075,223 A 6/2000 Harrison ..... 219/121.85
6,099,415 A 8/2000 Lutz ..... 473/357
6,129,881 A 10/2000 Puniello ..... 264/278
6,149,535 A 11/2000 Bissonnette et al. ..... 473/354
6,180,040 B1 1/2001 Ladd et al. ..... 264/248
6,180,722 B1 1/2001 Dalton et al. ..... 525/193
6,207,784 B1 3/2001 Rajagopalan ..... 528/71
6,213,898 B1 4/2001 Ogg ..... 473/383
6,235,230 B1 5/2001 Puniello ..... 264/278
6,241,622 B1 6/2001 Gobush et al. ..... 473/199
6,248,804 B1 6/2001 Lutz ..... 523/160
6,265,476 B1 7/2001 Krongauz et al. ..... 524/262
6,286,364 B1 9/2001 Aoyama et al. ..... 73/65.03
6,290,615 B1 9/2001 Ogg ..... 473/378
6,315,915 B1 11/2001 Hebert et al. ..... 216/67
6,338,684 B1 1/2002 Winfield et al. ..... 473/378
6,358,161 B1 3/2002 Aoyama ..... 473/383
6,379,138 B1 4/2002 Puniello et al. ..... 425/116
6,383,092 B1 5/2002 Ogg ..... 473/378
6,409,615 B1 6/2002 McGuire et al. ..... 473/383
6,441,056 B2 * 8/2002 Keller ..... 522/81
6,462,303 B1 10/2002 Brown ..... 219/121.69
6,488,591 B1 12/2002 Gobush et al. ..... 473/199
6,494,795 B2 12/2002 Sullivan ..... 473/372
6,500,073 B1 12/2002 Gobush et al. ..... 473/199
6,500,495 B2 12/2002 Lutz ..... 427/500
2001/0009310 A1 7/2001 Hebert et al.
2001/0018375 A1 8/2001 Hayashi et al.
2001/0019971 A1 9/2001 Hayashi et al.
2002/0025862 A1 2/2002 Sullivan et al.
2002/0028885 A1 3/2002 Sullivan et al.
2002/0082358 A1 6/2002 Ohira et al.
2002/0151380 A1 10/2002 Sullivan
2002/0187857 A1 12/2002 Kuntimaddi et al.

OTHER PUBLICATIONS

U.S. Appl. No. 10/229,344, filed Aug. 27, 2002 entitled "Golf Balls Comprising Glass Ionomers, Ormocers, or Other Hybrid Organic/Inorganic Compositons".
U.S. Appl. No. 10/228,311, filed Aug. 27, 2002 entitled "Golf Balls Comprising Light Stable Materials and Methods for Making Same".
U.S. Appl. No. 10/190,705, filed Jul. 9, 2002 entitled "Low Compression, Resilient Golf Balls With Rubber Core".
U.S. Appl. No. 10/167,744, filed Jun. 13, 2002 entitled "Golf Ball With Multiple Cover Layers".
U.S. Appl. No. 10/138,304, filed May 6, 2002 entitled "Golf Ball Incorporating Grafted Metallocene Catalyzed Polymer Blends".
U.S. Appl. No. 10/078,417, filed Feb. 21, 2002 entitled "Dimple Patterns for Golf Balls".
U.S. Appl. No. 10/028,826, filed Dec. 28, 2001 entitled "Golf Ball With An Improved Intermediate Layer".
U.S. Appl. No. 10/012,538, filed Dec. 12, 2001 entitled "Method of Forming Indicia on a Golf Ball".
U.S. Appl. No. 09/989,191, filed Nov. 21, 2001 entitled "Golf Ball Dimples With a Catenary Curve Profile".
U.S. Appl. No. 09/923,071, filed Aug. 6, 2001 entitled "Golf Balls Including A Staged Resin Film and Methods of Making Same".
U.S. Appl. No. 09/842,829, filed Apr. 27, 2001 entitled "All Rubber Golf Ball With Hoop-Stress Layer".
U.S. Appl. No. 09/841,910, filed Apr. 27, 2001 entitled "Multilayer Golf Ball With Hoop-Stress Layer".
U.S. Appl. No. 09/767,723, filed Jan. 24, 2001 entitled "Multi-Layer Golf Ball".
U.S. Appl. No. 09/742,435, filed Dec. 22, 2000 entitled "Split Vent Pin for Injection Molding".
U.S. Appl. No. 09/717,136, filed Nov. 22, 2000 entitled "Method of Making Golf Balls".
U.S. Appl. No. 09/442,845, filed Nov. 18, 1999 entitled "Mold for a Golf Ball" (Japanese Abstract submitted).

* cited by examiner

GOLF BALL COMPRISING UV-CURED NON-SURFACE LAYER

FIELD OF THE INVENTION

The present invention relates to golf balls including at least golf ball layer that has been treated with a radiation source to effect a complete cure of the materials used to form the layer.

BACKGROUND OF THE INVENTION

Golf ball manufacturers have been using ultraviolet irradiation to cure coatings and inks used on outer surfaces of golf balls for many years. For example, the use of a ultraviolet curable top coat is believed to eliminate the need for the traditionally used primer coat because of increased adhesion to the golf ball cover, as disclosed in U.S. Pat. No. 5,827,134. In addition, this patent teaches the ultraviolet curing of a partially neutralized copolymers of ethylene and acrylic acid to form a cured golf ball cover layer. U.S. Pat. Nos. 6,013,330 and 6,099,415 discuss the use of ultraviolet radiation curable ink to print an indicia or logo on outer surfaces of golf balls. The coating and/or inks typically used with such treatment are extremely thin, however, i.e., less than about 0.001 inches.

Radiation treatment has also been employed to seal the needle puncture holes necessary to insert liquid into fluid-filled golf ball cores. U.S. Pat. Nos. 5,922,252 and 5,624,332 teach methods of plugging the puncture holes with materials that solidify upon application of ultraviolet light radiation.

The list of additives in various golf ball layer compositions, particular covers, has recently included ultraviolet light absorbers and/or ultraviolet light stabilizers. For example, because the polyurethanes used to make the covers of golf balls typically contain an aromatic component, e.g., an aromatic diisocyanate, polyol or polyamine, they are susceptible to discoloration upon exposure to light, particularly ultraviolet light. To slow down this discoloration, light and UV stabilizers, e.g., TINUVIN® 770, 765 and 328, are added to these aromatic polymeric materials.

In addition, the recent trend toward light stable cover materials has introduced durability and adhesion issues, particularly between the inner cover layer and a polyurethane outer cover layer. For example, the inner components of most commercially available polyurethane golf balls undergo a surface treatment, e.g., corona discharge/silane dipping, to overcome the adhesion problems. The surface treatment, however, adds cost and time to the manufacturing process.

U.S. Pat. No. 6,265,476 discusses radiation curable binder compositions for optical fibers, glass substrates, and sewing threads with enhanced durability and elongation. The properties of such compositions would be beneficial in golf ball inner components, however, there is no such development in this area for golf ball manufacturing.

Thus, a need exists in the golf ball art for a material that is easily processed, but one that has good durability as a golf ball layer. In addition, a need exists for improved layer materials that reduce or eliminate adhesion problems with materials used in other inner layers, cover layers, and coating layers. Moreover, a need exists in the art for a method to use this material to form highly durable, resilient golf balls tailorable to have virtually any combination of feel and spin rate.

SUMMARY OF THE INVENTION

The present invention is directed to a golf ball including at least one structural layer formed of a composition including a polymer component including at least one radiation-curable moiety and at least one initiator present in an amount sufficient to initiate cure of the composition upon exposure to the radiation source. In one embodiment, the initiator includes a photoinitiator, a visible light initiator, or a combination thereof. The initiator may be present in an amount of about 0.1 percent to about 5 percent by weight of the composition.

The polymer component may includes a polymer, an oligomer, or monomer having at least one acrylate or methacrylate group. In another embodiment, the polymer component includes a prepolymer, and wherein the prepolymer includes at least two prepolymer functional moieties. In still another embodiment, the polymer component includes at least one of a glass ionomer, an ormocer, inorganic-organic material, or a combination thereof. In yet another embodiment, the polymer component may include a radiation-curable ionomer having the general formula:

$$B(X)_m(Y)_n$$

wherein B represents an organic backbone, wherein each X is an ionic group capable of undergoing a setting reaction in the presence of water and a reactive powder, wherein each Y is a radiation-curable group selected from the group consisting of free radical radiation-curable ethylenically unsaturated groups, cationic radiation-curable vinyl ether groups, cationic radiation-curable epoxy groups, and mixtures thereof, wherein m is a number having an average value of 2 or more, and wherein n is a number having an average value of 1 or more.

In one embodiment, the at least one structural layer is a cover layer. In another embodiment, the golf ball further includes a coating layer disposed about the cover layer.

The present invention is also directed to a golf ball including: a core; a cover; and an intermediate layer disposed between the core and the cover formed from an radiation-curable composition including a polymer component having (1) at least one ultraviolet-light curable moiety and (2) a photoinitiator. The photoinitiator may be present in an amount of about 0.2 percent to about 2.5 percent by weight of the composition.

In this aspect of the invention, the radiation-curable composition may further include a visible light initiator. And, in one embodiment, the polymer component is present in the composition in an amount of about 50 percent to about 99 percent by weight of the composition. In another embodiment, the cover includes a polyurethane, a polyurea, or a mixture thereof.

The present invention is further directed to a golf ball including an inner ball and a cover disposed about the inner ball, wherein at least one layer of the inner ball includes a radiation-curable composition including: (1) a polymer component having at least one ultraviolet-light curable moiety and (2) a photoinitiator, wherein the composition has a dry peel strength of about 0.5 pounds per linear inch or greater and a wet peel strength of about 0.25 pounds per linear inch or greater. In one embodiment, the dry peel strength is about 1 pound per linear inch or greater. In another embodiment, the wet peel strength is about 0.5 pounds per linear inch or greater.

In this aspect of the invention, the at least one layer may be an inner cover layer, an outer core layer, an intermediate layer, a center, and the like.

DETAILED DESCRIPTION OF THE INVENTION

Figure 1:
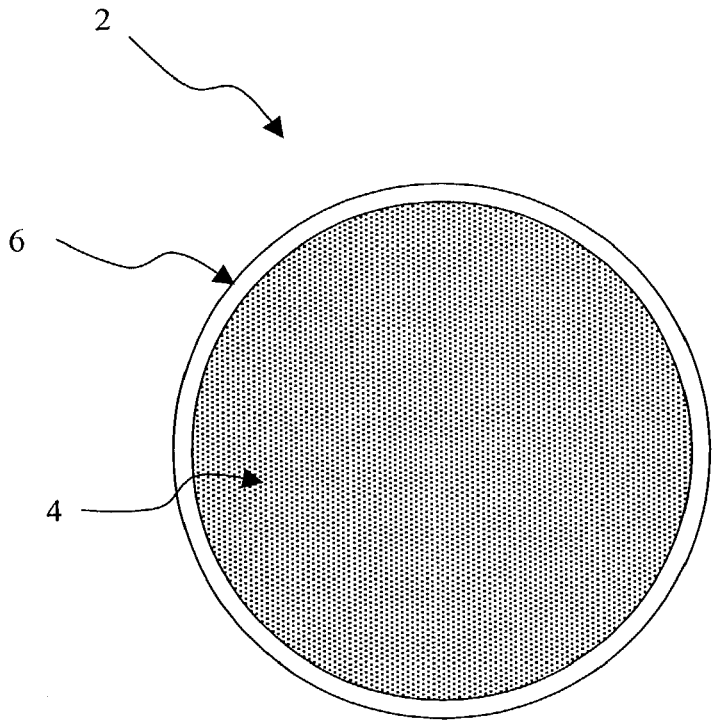
FIG. 1 is a cross-sectional view of a two layer ball, wherein at least a portion of the golf ball is formed from the compositions of the invention.

The present invention is directed to a golf ball including at least one structural layer formed of a composition that may be cured upon exposure to electromagnetic radiation. In addition, the present invention relates to methods of forming golf balls of the invention. The radiation-curable layer may be any layer beneath the outermost coating layer, e.g., core, inner or outer cover layers, and any layers therebetween, and may be applied as a liquid or solid composition. The composition preferably includes at least a minimal amount of initiator or catalyst so that upon exposure to radiation, the composition is cured or polymerized to form a durable layer of a golf ball. In addition to durability, the radiation curable compositions of the invention may be used to increase adhesion between layers of a golf ball.

The radiation-curable compositions of the invention may be used in two-layer balls, three-layer balls, and balls having more than three-layers, which will be discussed in more detail below.

Compositions of the Invention

The radiation-curable composition of the invention may include a variety of polymer components, however, the composition preferably includes at least one initiator or catalyst that initiates or accelerates cure of the composition upon exposure to the radiation source. As used herein, the term "radiation-curable" refers to the ability to be cured with a selected radiation source. Thus, the composition of the invention preferably includes a polymer component and an initiator and/or catalyst, and optionally, a crosslinking agent.

The compositions of the invention are curable by a radiation source, but are thermally stable at temperatures used to process uncured compositions, e.g., those required for mixing and extruding. As used herein, "thermally stable" means that the compositions do not spontaneously form a crosslinked network, i.e., cure.

Polymer Component

In one embodiment, the composition includes a polymer, oligomer, or monomer having at least one acrylate or methacrylate group. In another embodiment, the composition includes an oligomer, or monomer having an ethylenically unsaturated functional group. As used herein, oligomer refers to a polymer molecule that has a small number of monomers, e.g., dimer, trimer, tetramer. As used herein, monomer refers to a molecule of low molecular weight capable of reacting with identical or different molecules of low molecular weight to form a polymer.

The polymers for use in the composition of the present invention may include alkyl acrylates; hydroxyl alkyl acrylates; hydroxy acrylates; methacrylates; silicone containing compounds, such as siloxane; vinyl caprolactams, such as vinyl pyrrolidone; vinyl ethers; vinyl ether esters, such as vinyl ether maleate; vinyl ether acrylates; vinyl ether silicones; urethane acrylates; urethane methacrylates; epoxy acrylates; epoxy silicones; styrenes; ethers; allylic alcohols; epoxies; allylic glycidyl ethers; acyl halides; isocyanates; and mixtures thereof. Other suitable compounds include, but are not limited to, styrene; vinyl toluene; alpha-methyl styrene; divinyl benzene; methyl methacrylate; ethyl acrylate; butyl acrylate; hydroxy propyl-methacrylate; isocyanate; acyl chloride; polyglycidyl methacrylate; monohydroxyl alkyl ester; hydroxyl bearing esters of an alpha-beta olefinically unsaturated carboxylic acid, urethanes, amides, nitriles, alkenes, and isocyanates; and mixtures thereof.

In one embodiment, the radiation-curable composition of the invention includes a prepolymer having at least two prepolymer functional moieties and an initiator. The prepolymer may be selected from the group consisting of a first acrylate, an ester, and mixtures thereof and at least one polymerizable monomer. Suitable first acrylates for use in conjunction with the present invention include, but are not limited to, acrylated amines, acrylic acrylates, oil acrylates, melamine acrylates, heterocyclic acrylates, epoxy acrylates, epoxy acrylates of bisphenol A, epoxy acrylates of bisphenol F, epoxy acrylates of bisphenol S, novolak acrylates, urethane acrylates, ether acrylates, polyether acrylates, thiol acrylates, thioether acrylates, polythioether acrylates, silicon acrylates, polystyryl acrylates, ester acrylates, polyester acrylates, aromatic acrylates, aliphatic acrylates, half-ester acrylates, di-ester acrylates, vinyl acrylates, polybutadiene acrylates, allyl acrylates, polyene acrylates, methacrylates, methacrylated amine, acrylic methacrylates, methacrylic methacrylates, oil methacrylates, melamine methacrylates, heterocyclic methacrylates, epoxy methacrylates of bisphenol A, epoxy methacrylates of bisphenol F, epoxy methacrylates of bisphenol S, novolak methacrylates, urethane methacrylates, ether methacrylates, polyether methacrylates, thiol methacrylates, thioether methacrylates, polythioether methacrylates, silicon methacrylates, polystyryl methacrylates, ester methacrylates, polyester methacrylates, aromatic methacrylates, aliphatic methacrylates, half-ester methacrylates, di-ester methacrylates, vinyl methacrylates, polybutadiene methacrylates, allyl acrylates, polyene methacrylates and the like and mixtures thereof.

The first acrylates are acrylated prepolymers having high molecular weights, for example, of at least about 500 grams per mole and have at least 2 polymerizable functionalities (i.e., prepolymer moieties) per molecule of prepolymer. Often, the acrylated prepolymers and the ester prepolymers have a high viscosity (e.g., 100–20,000 centipoise at 25° C.) and a molecular weight of between about 500 to about 5,000 grams per mole and between about 2 to 6 reactive prepolymer functional moieties per molecule. The ester may be an unsaturated ester.

The polymerizable monomers may be monofunctional monomers or poly-functional monomers. Suitable monomers include, but are not limited to, one or more monofunctional acrylates or one or more polyfunctional acrylates. For example, the monofunctional acrylates have one acryloyl or methacryloyl group per acrylate molecule whereas the polyfunctional acrylates have two or more acryloyl or methacryloyl groups per acrylate molecule.

In addition, novel hybrid materials, such as glass ionomers, ormocers, and other inorganic-organic materials, such as the ones disclosed in co-pending U.S. patent application Ser. No. 10/229,344, filed Aug. 27, 2002, entitled "Golf Balls Comprising Glass Ionomers, Ormocers, or Other Hybrid Organic/Inorganic Compositions," the disclosure of which is incorporated by reference, may be used in the compositions of the present invention. As used herein, the term "hybrid material" includes glass ionomers, resin-modified glass ionomers, ormocers, inorganic-organic materials, silicon ionomers, dental cements or restorative compositions, polymerizable cements, ionomer cements, metal-oxide polymer composites, ionomer cements, aluminofluorosilicate glasses, fluoroaluminosilicate glass powders, polyalkenoate cements, flexible composites, and blends thereof.

In another embodiment, the polymer component of the radiation-curable composition includes a radiation-curable ionomer, such as those disclosed in U.S. Pat. No. 5,925,715, which is incorporated in its entirety by reference herein. As used herein, the term "radiation-curable ionomer" refers to a polymer having sufficient pendent ionic groups to undergo a setting reaction in the presence of a reactive powder and water, and sufficient pendent polymerizable groups to enable the resulting mixture to be cured, i.e., polymerized, upon exposure to a radiation source. The reactive powder may include metal oxides, metal hydroxides, mineral silicate, ion-leachable glass capable of reacting with the ionomer in the presence of water to form a hydrogel, or mixtures thereof. The general formula for radiation-curable ionomers is:

$$B(X)_m(Y)_n$$

wherein B represents an organic backbone; each X independently is an ionic group capable of undergoing a setting reaction in the presence of water and a reactive powder; each Y independently is a radiation-curable group selected from the group consisting of free radical radiation-curable ethylenically unsaturated groups, cationic radiation-curable vinyl ether groups, cationic radiation-curable epoxy groups, and mixtures thereof; m is a number having an average value of 2 or more, and n is a number having an average value of 1 or more.

In yet another embodiment, the polymer component includes curable elastomeric components capable of being crosslinked at low temperatures, such as uncured ethylene copolymer rubber, uncured acrylate rubber, and uncured elastomeric copolymer of a diene and an unsaturated nitrile. For example, the polymer component may include: (1) ethylene copolymers and a comonomer having $C_1$–$C_8$ alkyl esters of acrylic acid, $C_1$–$C_8$ alkyl esters of methacrylic acid, vinyl esters of $C_2$–$C_8$ carboxylic acids, and mixtures thereof; (2) alkyl acrylate polymers including homopolymers of $C_1$–$C_{10}$ alkyl acrylates with about 40 percent or less monovinyl monomer; and (3) diene copolymers including copolymers of a diene and an unsaturated nitrile and hydrogenated copolymers of a diene and an unsaturated nitrile. Examples of such UV curable elastomer components are disclosed in International Publication No. WO 99/37731, which is incorporated by reference herein in its entirety.

In still another embodiment, the polymer component(s) of the composition may be part of an interpenetrating polymer network (IPN), i.e., The IPNs may be sequential, simultaneous, grafted, semi, full, homo, gradient, thermoplastic, and latex as decribed in U.S. Patent Publication No. US2002/0187857, which is incorporated in its entirety by reference herein.

The polymer component of the composition is preferably present in an amount from about 10 percent to about 100 percent by weight of the composition. In one embodiment, the polymer component is present in an amount of about 15 percent or greater by weight of the composition. In another embodiment, the polymer component is present in an amount of about 90 percent or less by weight of the composition. In yet another embodiment, the polymer component is present in an amount of about 20 percent to about 80 percent by weight of the composition. In still another embodiment, the polymer component is present in an amount of about 50 percent to about 99 percent by weight of the composition.

Initiator(s) and Catalyst(s)

While it is possible to cure, i.e., polymerize, the compositions of the invention without an initiator, the use of one may aid in achieving an economically feasible and fast cure rate. Increased cure rates yield higher production rates and lower per unit production costs of various inked articles such as game balls, golf balls and the like. Any initiator or catalyst that initiates or accelerates cure of the composition upon exposure to a selected radiation source is suitable for use with the present invention. In one embodiment, the initiator includes at least one photoinitator, visible light initiator, or the like. The initiator is preferably present in an amount sufficient that, upon exposure to a radiation source, the composition is cured or polymerized to produce a durable layer of a golf ball.

When the composition of the invention is cured with ultraviolet radiation, the initiator preferably includes at least one photoinitiator. Any photoinitiator that acts to catalyze or accelerate cure by exposure to ultraviolet radiation is suitable for use with the present invention. Non-limiting examples include, but are not limited to, benzophenone and derivatives thereof, acetophenone, benzoin, benzoin methyl ether, benzoin butyl ether, acyloin, alcyloin ether, Michler's ketone, xanthone, thioxanthone, propriophenone, fluorenone, carbazole, diethoxyacetophenone, 2-, 3-, and 4-methylacetophenone, 2-, 3-, and 4-methoxy-acetophenone, 2- and 3-chloroxanthones, 2- and 3-chlorothioxanthones, 2-acetyl-4-methylphenylacetate, 2,2'-dimethoxy-2-phenylacetophenone, benzaldehyde, fluorene, anthraquinone, triphenylamine, 3- and 4-allylacetophenone, p-diacetylbenzene, 3-chloro-2-nonylxanthone, 2-chlorobenzophenone, 4-methoxybenzophenone, 2-chloro-4'-methylbenzophenone, 4-chloro-4'-methylbenzophenone, 3-methylbenzophenone, 4-tertbutylbenzophenone, isobutyl ether-benzoic acetate, bezilic acid, amino benzoate, methyl blue, 2,2-diethoxyacetophenone, 9,10-phenanthrenequinone, 2-methyl anthraquinone, 2-ethyl anthraquinone, 1-tert-butyl anthraquinone, 1,4-napthaquinone, 2-isopropylthioxanthone, 2-methylthioxanthone, 2-decylthioxanthone, 2-dodecylthioxanthone, oligo(2-hydroxy-2-methyl-1-(4-(1-methylvinyl)phenyl)propanone), 2,4,6-trimethylbenzophenone, 4-methylbenzophenone, 2,2-dimethoxy-1,2-diphenylethanone, 2-butoxy-1,2-diphenylethanone, 2-(2-methyl propoxy)-1,2-diphenylethanone, alpha hydroxy ketones such as 2-alpha hydroxy ketone, and combinations thereof. Additional examples of suitable photoinitiators are also listed in U.S. Pat. Nos. 4,670,295 and 4,680,368, which are incorporated herein by reference in their entirety.

Commercially available examples of suitable photoinitiators include 2,4,6-trimethylbenzoyl-di-phenylphosphinoxid, 2-methyl-1-[4-(methylthio)phenyl]-2-morpholino-propane-1-one, 1-hydroxy-cyclohexylphenyl-ketone, 2-hydroxy-2-methyl-1-phenyl-1-propanone, ethyl-4-(dimethylamino) benzoate, isopropyl thioxanthone (mixture of 2-and 4-isomers), 4-benzoyl-4'-methyl diphonyl sulfide, 2-ethylhexyl-4-dimethylaminobenzoate, methyl O-benzoyl benzoate, benzil dimethyl ketal, 4-methylbenzophenone, 4-chlorophenyl-benzophenone, tribromomethyl phenylsulfones, blends of methylbenzophenone and benophenone (1:1), blends of 1-hydroxy-cyclonexylphenyl-ketone and benzophenone, blends of 2-hydroxy-2-methyl-1-phenyl-1-propanone and 1-hydroxy-cyclonexylphenyl-ketone, blends of 2,4,6-trimethylbenzoyl-diphenyl phosphine and 1-hydroxy-2-methyl-1-phenyl-1-propanone, and mixtures thereof. These photoinitiators are available from Runtec Chemical Co., Ltd. of China under the tradename RUNTECURE®.

Other suitable commercially available photoinitiators include, but are not limited to, 1-hydroxy cyclohexyl phenyl ketone (IRGACURE® 184), 2-benzyl-2-dimethylamino-1-(4-morpholinophenyl)-butanone-1 (IRGACURE® 369), 50/50 mixture of 1-hydroxycyclohexyl-phenyl-ketone (IRGACURE® 184) and benzophenone (IRGACURE® 500), 2,2-dimethoxy-1,2-diphenylethan-1-one (IRGACURE® 651), 2-methyl-1 [4-(methylthio)phenyl]-2-morpholinopropan-1-one (IRGACURE® 907), 25/75 mixture of bis(2,6-dimethoxybenzoyl)-2,4,4-trimethyl pentylphosphineoxide and 2-hydroxy-2-methyl-1-phenyl-propan-1-one (IRGACURE® 1700), 1-[4-(2-hydroxyethoxy)-phenyl]-2-hydroxy-2-methyl-1-propane-1-one (IRGACURE® 2959), 2-hydroxy-2-methyl-1-phenyl-propan-1-one (DAROCUR® 1173), 50/50 mixture of 2,4,6-trimethylbenzoyl-diphenyl-phosphineoxide and 2-hydroxy-2-methyl-1-phenyl-propan-1-one (DAROCUR® 4265), benzoin methyl ether; or mixtures thereof. These photoinitiators are commercially available from Ciba-Geigy.

Another example of a commercially available photoinitiator suitable for use with the present invention is ESACURE® KIP-100F, which is manufactured by Sartomer Company of Exton, PA. ESACURE® KIP-100F is a liquid mixture of 70 percent by weight of oligo(2-hydroxy-2-methyl-1-(4-(1-methylvinyl)propanone) and 30 percent by weight of 2-hydroxy-2-methyl-1-phenyl-1-propanone.

Because photoinitiators are typically expensive, the amount of photoinitiator is preferably optimized to the minimum amount needed to affect cure of the composition. Thus, the photoinitiator is preferably present in an amount of about 0.05 percent to about 15 percent or less by weight of the composition. In one embodiment, the photoinitiator is present in an amount of about 0.05 percent to about 10 percent by weight of the composition. In another embodiment, the photoinitiator is present in an amount of about 0.1 percent to about 5 percent by weight of the composition. In still another embodiment, about 0.2 percent to about 2.5 percent of the photoinitator is present in the composition.

The composition may also include at least one visible light photoinitiator(s). As used herein, a "visible light photoinitiator" refers to a photoinitiator having at least a part of the absorbance spectrum in the visible region or a photoinitiator having the entire absorbance spectrum in the visible light region. In one embodiment, the visible light photoinitiator(s) should have a substantial portion, i.e., greater than about 50 percent, of the absorbance spectrum at wavelengths greater than about 400 nm. In another embodiment, the visible light photoinitiator has a maximum absorbance at wavelengths greater than about 400 nm. Visible light photoinitiators can be used in conjunction with or as substitutes for UV photoinitiators. In one embodiment, a combination of UV and visible light photoinitiators are used. In this aspect of the invention, the radiation source includes both UV and visible light.

Any compatible visible light photoinitiator may be used with the present invention. Visible light photoinitiators which are particularly suitable for the present invention include fluorene derivatives such as those described in U.S. Pat. Nos. 5,451,343 and 5,395,862, the contents of which are incorporated herein by reference in their entirety. Nonlimiting examples of fluorene derivatives include 5,7-diiodo-3-butoxy-6-fluorene (with a maximum absorbance at 470 nm); 2,4,5,7-tetraiodo-3-hydroxy-6-fluorene (with a maximum absorbance at 535 nm); and 2,4,5,7-tetraiodo-9-cyano-3-hydroxy-6-fluorene (with a maximum absorbance at 635 nm), all of which are available from Spectra Group Limited, Inc. Other visible light photoinitiators that are useful for this invention include, but are not limited to, titanocene photoinitiators, e.g., fluorinated diaryl titanocenes; ketocoumarine photoinitiators, e.g., 3-ketocoumarine; acridine dyes, e.g., acriflavine; xanthene dyes, e.g., rose bengale or fluorescein; azine dyes, thiazine dyes, e.g., methylene blue; polymethine dyes, e.g., cyanines or merocyanines; diaryliodonium salts; triarylsulfonium salts; chromophore substituted halomethyl-s-triazines; halomethyl oxadiazoles; and mixtures thereof.

Because of their efficient absorptivity of visible light, the amounts of visible light photoinitiators used may be less than the amount of UV photoinitiators used in the composition. In one embodiment, the visible light photoinitiator is present in an amount of about 0.1 percent to about 3 percent by weight of the composition. In another embodiment, the visible light photoinitiator is present in an amount of about 0.02 percent to 0.1 percent by weight of the composition. In yet another embodiment, about 0.05 percent to 0.07 percent of the visible light photoinitiator is included.

Depending upon the photoinitiator, one or more co-initiators may be used in combination with the visible light photoinitiator to enhance the curing. One of skill in the art is aware of whether a given visible light photoinitiator should be used with a co-initiator and which co-initiator(s) should be combined with the photoinitiator. For example, when fluorene derivatives are used as visible light photoinitiators, an onium salt and/or an aromatic amine can be used as a co-initiator. Suitable onium salts include iodonium salts, e.g., phenyl-4-octyloxyphenyliodonium hexafluoroantimonate (OPPI), dodecyldiphenyliodonium hexafluoroantimonate (DDPI), and (4-(2-tetradecanol)-oxyphenyl)iodonium hexafluoroantimonate); sulfonium salts; pyrylium salts; thiapyrylium salts; diazonium salts; ferrocenium salts; and mixtures thereof. Suitable amine co-initiators include, but are not limited to, N,N-dimethyl-2,6-diisopropylaniline (DIDMA), ethyl- or octyl-para-(dimethylamino)benzoate (EDAB or ODAB respectively), N-phenylglycine (NPG), and mixtures thereof. Triarylalkyl-borate ammonium salts may also be used in conjunction with the fluorene visible light photoinitiator as a substitute for the amine co-initiator. Examples of such borate co-initiators include tetramethylammonium triphenylbutyl borate and butyryl choline triphenyl butylborate (available from Spectra Group Limited).

Examples of co-initiators which are compatible with the "dye" photoinitiators include amines, e.g., triethanolamine; phosphines/arsines, e.g., triphenylphosphine or triphenylarsine; sulphinates, e.g., sodium p-tolysulphinate; enolates, e.g., dimedone enolate; carboxylate, e.g., ascorbic acid; organotin compounds, e.g., benzyltrimethylstannane; borates, e.g., triphenyl borate; trichloromethyl-s-triazines, and mixtures thereof.

The ratio of the visible light photoinitiator to co-initiator(s) may range from about 1:5 to about 1:30. In one embodiment, the ratio is about 1:10 to about 1:25. In another embodiment, the ratio is about 1:20 to about 1:25.

Crosslinking Agent(s)

The crosslinking agents may include at least one multifunctional acrylic or methacrylic crosslinking agent, which contain at least two polymerizable unsaturated groups per molecule. The molecular weight of the crosslinking agents for use with the present invention is preferably about 150 to about 1,000. Examples of multifunctional crosslinking agents include, but are not limited to, ethylene glycol diacrylate, ethylene glycol dimethacrylate, 1,6-hexanediol diacrylate, 1,6-hexanediol dimethacrylate, 1,4-butandediol diacrylate, pentaerythritol triacrylate, pentaerythritol tetraacrylate, dipentaerythritol pentaacrylate, methoxy 1,6-hexanediolpentaerythritol triacrylate, trimethylolpropane triacrylate, tetraethylene glycol diacrylate, polymethacrylate urethanes, epoxy acrylates, polyester acrylate monomers and oligomers, trimethylolpropane propoxylate triacrylate, poly-n-butyleneoxide glycol diacrylate, bisphenol A alkylene oxide adduct diacrylates, and mixtures thereof.

Upon exposure to a radiation source, the crosslinking agents are preferably capable of homopolymerization. Thus, upon irradiation, two reactions occur simultaneously: (1) the crosslinking agent reacts with the polymer component to form interchain and intrachain crosslinks, resulting in a matrix; and (2) excess crosslinking agent will homopolymerize and form an interpenetrating network to reinforce the matrix.

The crosslinking agent, when present, is preferably included in an amount of about 2 percent to about 30 percent by weight of the composition. In one embodiment, the crosslinking agent is present in an amount of about 5 percent to about 20 percent by weight of the composition. In another embodiment, about 5 percent to about 15 percent of the crosslinking agent is present, by weight of the composition.

Reactive Diluent(s)

Reactive diluents are also contemplated for use with the present invention to modify, e.g., typically reduce, the viscosity of the composition and/or increase the surface wettability of the composition. Suitable diluents may include a diluent acrylate or methacrylate monomer, or a combination thereof. Nonlimiting examples include hydroxy alkyl methacrylates; 2-hydroxyethyl methacrylate; 2-hydroxypropyl methacrylate; ethylene glycol methacrylates; ethylene glycol methacrylate; diethylene glycol methacrylate; tri(ethylene glycol) dimethacrylate; tetra(ethylene glycol) dimethacrylate; diol dimethacrylates; butanedimethacrylate; dodecanedimethacryalte; 1,6-hexanedioldimethacrylate; and mixtures thereof.

Some of the polymer components previously discussed herein have a built-in reactive diluent. For example, in the prepolymer embodiment discussed above, the polymerizable monomers are considered reactive diluents. In other words, the polymerizable monomers are used to modify the viscosity of the acrylate prepolymer or the ester prepolymer. In addition, the hybrid materials discussed above may also include a diluent acrylate or methacrylate monomer in an amount sufficient to either increase the surface wettability or decrease the viscosity of the composition.

Non-reactive and Heat Curable Components

The compositions of the invention may also include non-reactive polymers and/or heat curable polymers. For example, in addition to the radiation-curable polymer, the compositions of the invention may include a polymer and/or monomer that is not radiation-curable, but instead curable by other means. In one embodiment, the curing means includes heating, cooling, time, or a combination thereof. This additional component may allow a partial cure of the composition to allow for a particular molding/forming process to occur, while postponing total cure to an appropriate time.

Elongation Promoter

In addition, the materials disclosed in U.S. Pat. No. 6,265,476, which is incorporated in its entirety by reference herein, may be useful in the compositions of the invention. For example, the compositions of the invention may include an elongation promoter in order to increase the elongation of the radiation-curable composition of the invention. The elongation promoter may be any compound sufficient to increase elongation of the composition, such as the ones disclosed in U.S. Pat. No. 6,265,476, which is incorporated by reference herein in its entirety. In one embodiment, the elongation promoter is a compound having straight and branched open chains, i.e., an aliphatic compound. In another embodiment, the elongation promoter may be a compound containing sulfur. In yet another embodiment, the elongation promoter is an aliphatic sulfur-containing compound, preferably one where the sulfur is bonded directly to a carbon atom of an aliphatic group. In still another embodiment, a compound including at least one mercapto (thiol) group may be used as the elongation promoter, which may be also be an aliphatic compound. A compound containing mixture of sulfur and mercapto (thiol) groups is also contemplated by the present invention.

In one embodiment, the elongation promoter is present in an amount sufficient to increase the elongation of the composition by about 100 percent or greater over a radiation-curable composition that lacks the elongation promoter. In another embodiment, the elongation promoter is present in an amount sufficient to increase the elongation of the composition by about 200 percent or greater as compared to a composition lacking the elongation promoter. In yet another embodiment, the elongation promoter is present in an amount effective to increase elongation by about 300 percent or greater over that of a similar composition without an elongation promoter. For example, the elongation promoter may be included in the composition in an amount of about 10 percent or less by weight of the composition. In another embodiment, the elongation promoter is present in an amount of about 8 percent or less.

Furthermore, because sulfur-containing compounds may be odorous in nature, when the the elongation promoter is a sulfur-containing compound, a fragrance component may be blended in with the compositions of the invention to mask any odors. The fragrance component is preferably added in an amount of about 0.01 percent to about 1.5 percent by weight of the composition. In one embodiment, the fragrance component is added to the composition in an amount of about 0.03 percent or greater by weight of the composition. In another embodiment, the fragrance component is added to the composition in an amount of about 1.2 percent or less by weight of the composition. In yet another embodiment, the fragrance component is added in an amount of about 0.5 percent to about 1 percent by weight of the composition. For example, an optimum loading of the fragrance component may be about 0.08 percent by weight of the composition, but adding more may enhance the effect if needed.

Suitable fragrance components include, but are not limited to, Long Lasting Fragrance Mask #59672, Long Lasting Fragrance Mask #46064, Long Lasting Fragrance Mask #55248, Non-Descript Fragrance Mask #97779, Fresh and Clean Fragrance Mask #88177, and Garden Fresh Fragrance Mask #87473, all of which are manufactured by Flavor and Fragrance Specialties of Mahwah, N.J. Other non-limiting examples of fragrance components that may be added to the compositions of the invention include benzaldehyde, benzyl benzoate, benzyl propionate, benzyl salicylate, benzyl alcohol, cinnamic aldehydes, natural and essential oils derived from botanical sources, and mixtures thereof.

Additives

The compositions of the invention described above may also include various additives. For example, fillers may be added to the compositions of the invention to affect Theological and mixing properties, the specific gravity, i.e., density-modifying fillers, the modulus, the tear strength, reinforcement, and the like. The fillers are generally inorganic, and suitable fillers include numerous metals, metal oxides and salts, such as zinc oxide and tin oxide, as well as barium sulfate, zinc sulfate, calcium oxide, calcium carbonate, zinc carbonate, barium carbonate, clay, tungsten, tungsten carbide, an array of silicas, regrind (recycled core material typically ground to about 30 mesh particle), high-Mooney-viscosity rubber regrind, and mixtures thereof.

In one embodiment, the compositions of the invention can be reinforced by blending with a wide range of density-adjusting fillers, e.g., ceramics, glass spheres (solid or hollow, and filled or unfilled), and fibers, inorganic particles, and metal particles, such as metal flakes, metallic powders, oxides, and derivatives thereof, as is known to those with skill in the art. The selection of such filler(s) is dependent upon the type of golf ball desired, i.e., one-piece, two-piece, multi-component, or wound, as will be more fully detailed below. In another embodiment, the filler will be inorganic, having a density of greater than 4 g/cc, and will be present in amounts between about 5 and about 65 weight percent based on the total weight of the polymer composition.

The compositions of the invention may also be foamed by the addition of the at least one physical or chemical blowing or foaming agent. The use of a foamed polymer allows the golf ball designer to adjust the density or mass distribution of the ball to adjust the angular moment of inertia, and, thus, the spin rate and performance of the ball. Foamed materials also offer a potential cost savings due to the reduced use of polymeric material. As used herein, the term "foamed" encompasses "conventional foamed" materials that have cells with an average diameter of greater than 100 pm and "microcellular" type materials that have closed cell sizes on the order of 2 to 25 gym. Examples of conventional foamed materials include those described in U.S. Pat. No. 4,274,637. Examples of microcellular closed cell foams include those foams disclosed in U.S. Pat. Nos. 4,473,665 and 5,160,674. In this embodiment, the polymer blend may be foamed during molding by any conventional foaming or blowing agent. Preferably, foamed layers incorporating an oxa ester or oxa ester blend have a flexural modulus of at least about 1,000 psi to about 150,000 psi.

Blowing or foaming agents useful include, but are not limited to, organic blowing agents, such as azobisformamide; azobisisobutyronitrile; diazoaminobenzene; N,N-dimethyl-N,N-dinitroso terephthalamide; N,N-dinitrosopentamethylene-tetramine; benzenesulfonyl-hydrazide; benzene-1,3-disulfonyl hydrazide; diphenylsulfon-3-3, disulfonyl hydrazide; 4,4'-oxybis benzene sulfonyl hydrazide; p-toluene sulfonyl semicarbizide; barium azodicarboxylate; butylamine nitrile; nitroureas; trihydrazino triazine; phenylmethyl-uranthan; p-sulfonhydrazide; peroxides; and inorganic blowing agents such as ammonium bicarbonate and sodium bicarbonate. A gas, such as air, nitrogen, carbon dioxide, and the like, may also be injected into the composition during the injection molding process.

A foamed composition of the present invention may also be formed by blending microspheres with the composition either during or before the molding process. Polymeric, ceramic, metal, and glass microspheres are useful in the invention, and may be solid or hollow and filled or unfilled. In particular, microspheres up to about 1000 micrometers in diameter are useful. Generally, either injection molding or compression molding may be used to form a layer or a core including a foamed polymeric material.

Other materials conventionally included in golf ball compositions may also be added to the compositions of the invention. These additional materials include, but are not limited to, reaction enhancers, crosslinking agents, optical brighteners, coloring agents, fluorescent agents, whitening agents, UV absorbers, hindered amine light stabilizers, defoaming agents, processing aids, mica, talc, nano-fillers, and other conventional additives. Antioxidants, stabilizers, softening agents, plasticizers, including internal and external plasticizers, impact modifiers, foaming agents, excipients, reinforcing materials and compatibilizers may also be added to any composition of the invention. In addition, heat stabilizers may be beneficial in enlarging the range of processing temperatures to greater than about 130° C.

Although the present invention addresses prior art adhesion problems, additional adhesion promoters may also be of use in the present composition. Suitable adhesion promoters include, but are not limited to, silane-containing adhesion promoters and lubricants.

All of these materials, which are well known in the art, are added for their usual purpose in typical amounts.

Radiation Sources

Radiation sources may vary depending on the initiator chosen for the composition. The invention contemplates any type of electromagnetic radiation, e.g., radio waves, microwaves, ultraviolet rays, infrared or heat rays, visible light, electron beam radiation, X-rays, and gamma rays, that travels at the speed of light. Thus, electromagnetic radiation having wavelengths in the ultraviolet and/or visible light regions of the spectrum, i.e., greater than about 400 nm, is suitable for use with the present invention. For example, the polymerization of the radiation-curable composition of the invention may be initiated by exposing the composition to a source of radiation at a wavelength within the ultraviolet or visible spectral regions providing the wavelength used overlaps the photoinitiator present in the composition.

Nonlimiting examples of radiation sources include carbon arc, xenon, mercury, and tungsten filament lamps, as well as sunlight. Other suitable ultraviolet radiation sources are disclosed in U.S. Pat. Nos. 4,501,993; 4,887,008; 4,859,906; 4,485,332; 4,313,969; 5,300,331; 3,872,349; 4,042,850; 4,507,587; 5,440,137; 3,983,039; and 4,208,587, each disclosure of which is incorporated herein by reference in its entirety. Commercially available UV radiation sources include, but are not limited to, Fusion Model 300 from Fusion Systems Corp. of Rockville, Md., Honle Model UVA Print 740 (e.g., fitted with a Mercury bulb, a metal halide bulb or another bulb having an output wavelength from about 200 nm to about 450 nm) from Honle Corp. of Marlboro, Mass. and UVEXS models designated as UVEXS Model CCU, UVEXS Model ECU, UVEXS Model SAC, UVEXS Model SACC, UVEXS Model OCU, UVEXS SCU and UVEXS Model 471, available from Ultraviolet Exposure Systems, Inc. of Sunnyvale, Calif.

Exposure time to affect cure may vary, as known to those of ordinary skill in the art, based on the amount of composition, the amount of initiator present, the radiation source, the distance from the source, and the like. In one embodiment, the exposure time is about 1 second to about 10 minutes. In another embodiment, the exposure time is about 1 second to about 5 minutes. In still another embodiment, the exposure time is about 1 second to about 1 minute.

When electron beam radiation is employed, the dosage preferably ranges from about 1 megarad to about 200 megarads, preferably from about 1 megarad to about 10 megarads.

As known to those of ordinary skill in the art, the use of thermal energy with the radiation source may help to accelerate cure. Thus, in one embodiment, a heat source is employed in addition to a radiation source. In addition, the use of a heat source is beneficial when the composition of the invention contains a blend of radiation-curable polymers and heat-curable polymers. Thus, the combination of curing sources effects a complete cure of the composition.

Any cure time can be used in the present invention which is sufficient to cure the radiation curable polymers of the present invention to a degree sufficient to provide a secure seal to the golf ball center. Preferable curing times are in the range of from less than 0.1 second to more than 15 minutes. The more preferred cure times are between from about less than 0.1 second to about five minutes. The most preferred cure times are from about 0.1 second to about 1 minute.

Thus, the degree of electromagnetic radiation required to affect cure of the composition of the invention will determine the source of electromagnetic radiation used.

Adhesion

Adhesion may be measured in terms of peel strength using the T-Peel test (ASTM D-1876-72). The compositions of the invention preferably have a dry peel strength of about 0.5 pound per linear inch (pli) and a wet peel strength of about 0.25 pli. In one embodiment, the dry peel strength is about 1 pli or greater. In another embodiment, the dry peel strength is about 1.5 pli or greater. In yet another embodiment, the wet peel strength is about 0.5 pli or greater. In still another embodiment, the wet peel strength is about 1 pli or greater.

Golf Ball Construction

The radiation curable compositions of the present invention may be used with any type of ball construction. For example, two-piece, three-piece, and four-piece golf ball designs are contemplated by the present invention. In addition, golf balls having double cores, intermediate layer(s), and/or double covers are also useful with the present invention. As known to those of ordinary skill in the art, the type of golf ball constructed, i.e., double core, double cover, and the like, depends on the type of performance desired of the ball. As used herein, the term "layer" includes any generally spherical portion of a golf ball, i.e., a golf ball core or center, an intermediate layer, and/or a golf ball cover. As used herein, the term "inner layer" refers to any golf ball layer beneath the outermost structural layer of the golf ball. As used herein, "structural layer" does not include a coating layer, top coat, paint layer, or the like. As used herein, the term "multilayer" means at least two layers.

Figure 2:
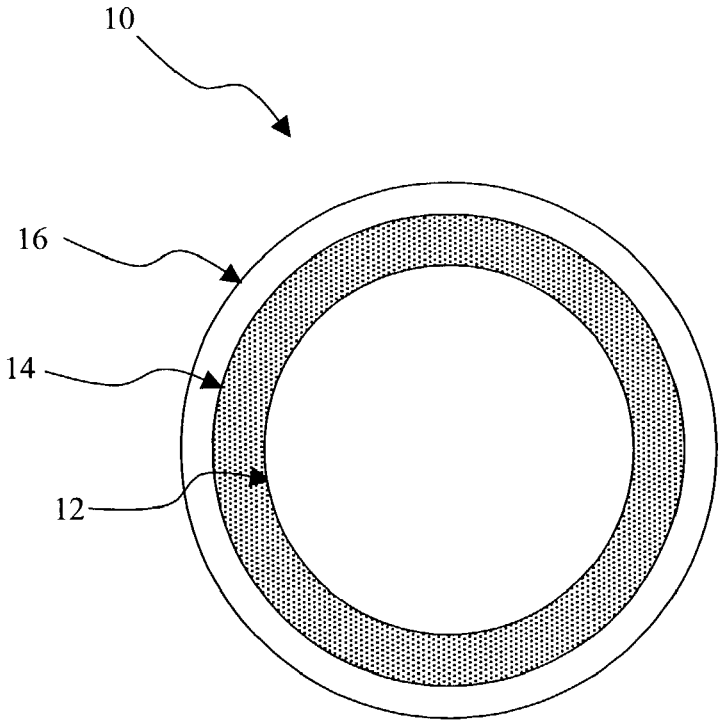
FIG. 2 is a cross-sectional view of a multi-component golf ball, wherein at least a portion of the golf ball is formed from the compositions of the invention.
Figure 3:
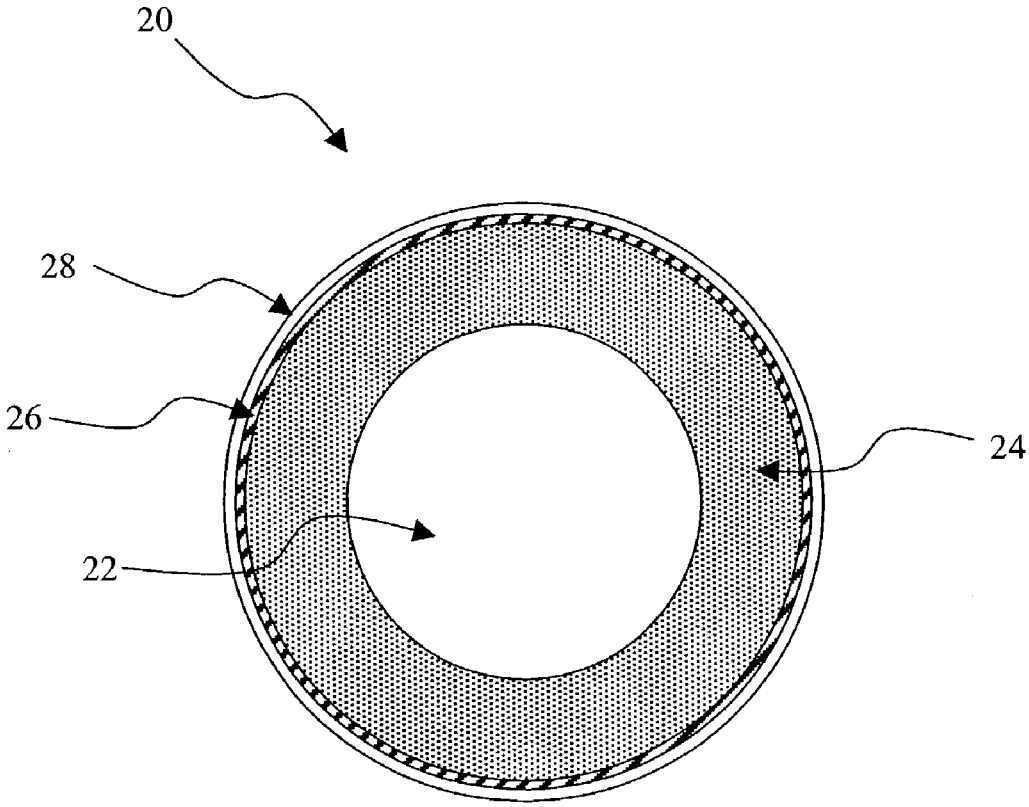
FIG. 3 is a cross-sectional view of a multi-component golf ball including a core, an outer core layer, a thin inner cover layer, and a thin outer cover layer disposed thereon, wherein at least a portion of the golf ball is formed from the compositions of the invention.

In one embodiment, a golf ball 2 according to the invention (as shown in FIG. 1) includes a core 4 and a cover 6, wherein the at least one of core 4 and cover 6 incorporates at least one layer including the radiation-curable composition of the invention. In another embodiment, the cover 6 is formed of the radiation-curable composition of the invention, which is preferably coated with a thin layer of topcoat. Similarly, FIG. 2 illustrates a golf ball according to the invention incorporating an intermediate layer. Golf ball 10 includes a core 12, a cover 16, and an intermediate layer 14 disposed between the core 12 and cover 16. Any of the core 12, intermediate layer 14, or cover 16 may incorporate at least one layer that includes the radiation-curable composition of the invention. FIG. 3 illustrates a four-piece golf ball 20 according to the invention including a core 22, an outer core layer or intermediate layer 24, an inner cover layer or intermediate layer 26, and an outer cover layer 28. Any of the core 22, outer core or intermediate layer 24, inner cover or intermediate layer 26, or outer cover layer 28 may include the radiation-curable composition of the invention.

Other non-limiting examples of suitable types of ball constructions that may be used with the present invention include those described in U.S. Pat. Nos. 6,056,842, 5,688,191, 5,713,801, 5,803,831, 5,885,172, 5,919,100, 5,965,669, 5,981,654, 5,981,658, and 6,149,535, as well as in Publication Nos. US2001/0009310 A1, US2002/0025862, US2002/0028885, US2002/0151380. The entire disclosures of these patents and published patent applications are incorporated by reference herein. For example, in Publication No. US2002/015380, a golf ball having three or more cover layers is disclosed, of which any of the layers of the ball may be formed using the radiation-curable compositions of the invention. In addition, the compositions of the invention are contemplated for use in layers of the gradated hardness multilayer golf balls disclosed in U.S. patent application Ser. No. 09/767,723, filed Jan. 24, 2001, entitled "Multi-Layer Golf Ball," which is incorporated by reference herein in its entirety.

As discussed, the golf balls of the invention include at least one structural layer that includes the radiation-curable compositions of the invention. In addition, as discussed below, the golf balls of the invention may include core layers, intermediate layers, or cover layers formed from materials known to those of skill in the art. These examples are not exhaustive, as skilled artisans would be aware that a variety of materials might be used to produce a golf ball of the invention with desired performance properties.

Core Layer(s)

The cores of the golf balls formed according to the invention may be solid, semi-solid, hollow, fluid-filled, or powder filled. As used herein, the term "core" means the innermost portion of a golf ball, and may include one or more layers. For example, U.S. Pat. Nos. 6,180,040 and 6,180,722 disclose methods of preparing dual core golf balls. The entire disclosures of these patents are incorporated by reference herein. The term "semi-solid" as used herein refers to a paste, a gel, or the like. The cores of the golf balls of the invention may be spherical, cubical, pyramid-shaped, geodesic, or any three-dimensional, symmetrical shape.

While the cores of the invention may be formed with the radiation-curable compositions of the invention, conventional materials may also be used to form the cores. Suitable core materials include, but are not limited to, thermoset materials, such as rubber, styrene butadiene, polybutadiene, isoprene, polyisoprene, trans-isoprene, and polyurethane, and thermoplastic materials, such as conventional ionomer resins, polyamides, polyesters, and polyurethane. In one embodiment, at least one layer of the core is formed from a polybutadiene reaction product, such as the reaction products disclosed in co-pending U.S. patent application Ser. No. 10/190,705, entitled, "Low Compression, Resilient Golf Balls With Rubber Core," filed Jul. 9, 2002, the entire disclosure of which is incorporated by reference herein.

Additional materials may be included in the core layer compositions outlined above. For example, catalysts, coloring agents, optical brighteners, crosslinking agents, whitening agents such as $TiO_2$ and ZnO, Uv absorbers, hindered amine light stabilizers, defoaming agents, processing aids, surfactants, and other conventional additives may be added to the core layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the core layer compositions. One of ordinary skill in the art should be aware of the requisite amount for each type of additive to realize the benefits of that particular additive. The core may also include one or more wound layers (surrounding a fluid or solid center) including at least one tensioned elastomeric material wound about the center. In one embodiment, the tensioned elastomeric material includes natural or synthetic elastomers or blends thereof. The synthetic elastomer preferably includes LYCRA. In another embodiment, the tensioned elastomeric material incorporates a polybutadiene reaction product as disclosed in co-pending U.S. patent application Ser. No. 10/190,705. In yet another embodiment, the tensioned elastomeric material may also be formed from conventional polyisoprene. In still another embodiment, a polyurea composition (as disclosed in co-pending U.S. patent application Ser. No. 10/228,311, filed Aug. 27, 2002, entitled "Golf Balls Comprising Light Stable Materials and Methods for Making Same," which is incorporated by reference in its entirety by reference herein) is used to form the tensioned elastomeric material. In another embodiment, solvent spun polyethers urea, as disclosed in U.S. Pat. No. 6,149,535, which is incorporated in its entirety by reference herein, is used to form the tensioned elastomeric material in an effort to achieve a smaller cross-sectional area with multiple strands.

The tensioned elastomeric layer may also be a high tensile filament having a tensile modulus of about 10,000 kpsi or greater, as disclosed in co-pending U.S. patent application Ser. Nos. 09/842,829 and 09/841,910, filed Apr. 27, 2001, entitled "All Rubber Golf Ball with Hoop-Stress Layer" and "MultiLayer Golf Ball With Hoop-Stress Layer," respectively, the entire disclosures of which are incorporated by reference herein.

In another aspect of the invention, the golf balls of the invention include a thin, highly filled layer, such as the ones disclosed in U.S. Pat. No. 6,494,795, which is incorporated by reference herein in its entirety. A thin, highly filled core layer allows the weight or mass of the golf ball to be allocated radially relative to the centroid, thereby dictating the moment of inertia of the ball. When the weight is allocated radially toward the centroid, the moment of inertia is decreased, and when the weight is allocated outward away from the centroid, the moment of inertia is increased.

For example, a low moment of inertia ball can be formed using a high specific gravity core layer encompassed by a low specific gravity layer. The low specific gravity layer may be formed using a density reducing filler or by some other means, e.g., by foaming. In this aspect of the invention, the core layer may have the highest specific gravity of all the layers in the golf ball. In one embodiment, the specific gravity of the core layer is greater than about 1.8, preferably greater than about 2.0, and more preferably greater than about 2.5. In another embodiment, the specific gravity of the core layer is about 5 or greater. In yet another embodiment, the specific gravity of the core layer is about 10 or greater.

In one embodiment, the highly filled layer is the center of the ball or the outer core layer, or both. This high specific gravity core layer may be formed from the radiation-curable compositions of the invention, which include the appropriate fillers to raise the specific gravity to the requisite amount. Alternatively, the highly filled core layer may be made from a high density metal or from metal powder encased in a polymeric binder. High density metals such as steel, tungsten, lead, brass, bronze, copper, nickel, molybdenum, or alloys may be used.

Intermediate Layer(s)

As used herein, "intermediate layer" includes any layer between the innermost layer of the golf ball and the outermost layer of the golf ball. Therefore, intermediate layers may also be referred to as outer core layers, inner cover layers, and the like. When the golf ball of the present invention includes an intermediate layer, this layer may be formed from the radiation-curable compositions of the invention. The intermediate layer may also be formed of conventional materials known to those of ordinary skill in the art, including various thermoset and thermoplastic materials, as well as blends thereof. For example, the intermediate layers of the golf ball of the invention may be formed with the compositions of the invention. The intermediate layer may likewise be formed, at least in part, from one or more homopolymeric or copolymeric materials, such as vinyl resins, polyolefins, polyurethanes, polyureas, polyamides, acrylic resins, olefinic thermoplastic rubbers, block copolymers of styrene and butadiene, isoprene or ethylene-butylene rubber, copoly(ether-amide), polyphenylene oxide resins, thermoplastic polyesters, ethylene, propylene, 1-butene or 1-hexene based homopolymers or copolymers, and the like.

The intermediate layer may also be formed from highly neutralized polymers such as those disclosed U.S. Patent Publication No. 2001/0018375 and 2001/0019971, which are incorporated herein in their entirety by express reference thereto; grafted and non-grafted metallocene catalyzed polyolefins and polyamides, polyamide/ionomer blends, and polyamide/nonionomer blends, such as those disclosed in U.S. patent application Ser. No. 10/138,304, filed May 6, 2002, entitled "Golf Ball Incorporating Grafted Metallocene Catalyzed Polymer Blends," which is incorporated by reference herein in its entirety; among other polymers. Examples of other suitable intermediate layer materials include blends of some of the above materials, such as those disclosed in U.S. Pat. No. 5,688,181, the entire disclosure of which is incorporated by reference herein.

Additional materials may be included in the intermediate layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants, and other conventional additives may be added to the intermediate layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the intermediate layer compositions. One of ordinary skill in the art should be aware of the requisite amount for each type of additive to realize the benefits of that particular additive.

The intermediate layer may also be formed of a binding material and an interstitial material distributed in the binding material, as discussed in U.S. patent application Ser. No. 10/028,826, filed Dec. 28, 2001, entitled, "Golf Ball with a Radially Oriented Transversely Isotropic Layer and Manufacture of Same," the entire disclosure of which is incorporated by reference herein. In addition, at least one intermediate layer may also be a moisture barrier layer, such as the ones described in U.S. Pat. No. 5,820,488, which is incorporated in its entirety by reference herein. The intermediate layer may also be formed from any of the polyurethane, polyurea, and polybutadiene materials discussed co-pending U.S. patent application Ser. No. 10/228,311.

Cover Layer(s)

The cover provides the interface between the ball and a club. As used herein, the term "cover" means the outermost portion of a golf ball. A cover typically includes at least one layer and may contain indentations such as dimples and/or ridges. Paints and/or laminates are typically disposed about the cover to protect the golf ball during use thereof. The cover may include a plurality of layers, e.g., an inner cover layer disposed about a golf ball center and an outer cover layer formed thereon.

Inner and/or outer cover layers may be formed of the compositions of the invention. When an outer cover layer is formed of the radiation-curable composition, a thin coating layer preferably is disposed about the outer cover layer. Alternatively, both the inner and/or outer cover layers of golf balls of the present invention may be formed of the highly neutralized ionomer compositions, other cover materials known to those of skill in the art, or blends thereof. For example, the cover may be formed of polyurea, polyurethane, or mixtures thereof, as disclosed in co-pending U.S. patent application Ser. Nos. 10/228,311, filed Aug. 27, 2002, entitled "Golf Balls Comprising Light Stable Materials and Methods of Making Same," and Ser. No. 10/339,603, filed Jan. 10, 2003, entitled "Polyurethane Compositions for Golf Balls." The entire disclosures of these applications are incorporated by reference herein.

In addition, cover layers may also be formed of one or more homopolymeric or copolymeric materials, such as vinyl resins, polyolefins, conventional polyurethanes and polyureas, such as the ones disclosed in U.S. Pat. Nos. 5,334,673, and 5,484,870, polyamides, acrylic resins and blends of these resins with poly vinyl chloride, elastomers, and the like, thermoplastic urethanes, olefinic thermplastic rubbers, block copolymers of styrene and butadiene, polyphenylene oxide resins or blends of polyphenylene oxide with high impact polystyrene, thermoplastic polyesters, ethylene, propylene, 1-butene or 1-hexane based homopolymers or copolymers including functional monomers, methyl acrylate, methyl methacrylate homopolymers and copolymers, low acid ionomers, high acid ionomers, alloys, and mixtures thereof. The cover may also be at least partially formed from a polybutadiene reaction product.

Additional materials may be included in the cover layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants, and other conventional additives may be added to the cover layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the cover layer compositions. Those of ordinary skill in the art should be aware of the requisite amount for each type of additive to realize the benefits of that particular additive.

In addition, while hardness gradients are typically used in a golf ball to achieve certain characteristics, the present invention also contemplates the compositions of the invention being used in a golf ball with multiple cover layers having essentially the same hardness, wherein at least one of the layers has been modified in some way to alter a property that affects the performance of the ball. Such ball constructions are disclosed in co-pending U.S. patent application Ser. No. 10/167,744, filed Jun. 13, 2002, entitled "Golf Ball with Multiple Cover Layers," the entire disclosure of which is incorporated by reference herein.

As discussed above with respect to the core of the golf balls of the invention, the use of a thin, highly filled layer allows the weight or mass of the golf ball to be allocated radially relative to the centroid, thereby dictating the moment of inertia of the ball. This concept is translatable to the cover layers of a golf ball. Thus, the inner cover layer may be a thin, dense layer so as to form a high moment of inertia ball. In this aspect of the invention, the inner cover layer preferably has a specific gravity of greater than 1.2, more preferably more than 1.5, even more preferably more than 1.8, and most preferably more than 2.0. Suitable materials for the thin, dense layer include any material that meets the specific gravity stated above. For example, this thin, highly filled inner cover layer may be formed of the radiation-curable compositions of the invention, adjusting for the requisite specific gravity. Alternatively, the inner cover layer may be formed from epoxies, styrenated polyesters, polyurethanes or polyureas, liquid PBR's, silicones, silicate gels, agar gels, and the like.

Methods for Forming

The golf balls of the invention may be formed using a variety of application techniques such as compression molding, flip molding, injection molding, retractable pin injection molding, reaction injection molding (RIM), liquid injection molding (LIM), casting, vacuum forming, powder coating, flow coating, spin coating, dipping, spraying, and the like. A method of injection molding using a split vent pin can be found in co-pending U.S. patent application Ser. No. 09/742,435, filed Dec. 22, 2000, entitled "Split Vent Pin for Injection Molding." Examples of retractable pin injection molding may be found in U.S. Pat. Nos. 6,129,881, 6,235,230, and 6,379,138. These molding references are incorporated in their entirety by reference herein. In addition, a chilled chamber, i.e., a cooling jacket, such as the one disclosed in U.S. patent application Ser. No. 09/717,136, filed Nov. 22, 2000, entitled "Method of Making Golf Balls" may be used to cool the compositions of the invention when casting, which also allows for a higher loading of catalyst into the system.

One skilled in the art would appreciate that the molding method used may be determined at least partially by the properties of the composition. For example, casting, RIM, or LIM may be preferred when the material is thermoset, whereas compression molding or injection molding may be preferred for thermoplastic compositions. Compression molding, however, may also be used for thermoset inner ball materials. For example, when cores are formed from a thermoset material, compression molding is a particularly suitable method of forming the core, whereas when the cores are formed of a thermoplastic material, the cores may be injection molded. In addition, the intermediate layer may also be formed from using any suitable method known to those of ordinary skill in the art. For example, an intermediate layer may be formed by blow molding and covered with a dimpled cover layer formed by injection molding, compression molding, casting, vacuum forming, powder coating, and the like.

When an inner layer is formed of a radiation-curable composition of the invention, the inner layer may be formed using a staged resin film concept, which is an alternative to casting or injection molding and permits ball designs with more specific weight distribution and alterations in moisture transmission. Methods of forming a staged resin film are disclosed in co-pending U.S. patent application Ser. No. 09/923,071, filed Aug. 6, 2001, entitled "Golf Balls Including a Staged Resin Film and Methods of Making Same," which is incorporated in its entirety by reference herein.

In addition, when covers for the golf balls of the invention are formed of polyurea and/or polyurethane compositions, these materials may be applied over an inner ball using a variety of application techniques such as spraying, compression molding, dipping, spin coating, casting, or flow coating methods that are well known in the art. Examples of forming polyurea and polyurethane materials about an inner ball are disclosed in U.S. Pat. Nos. 5,733,428, 5,006,297, and 5,334,673, which are incorporated by reference in their entirety herein. In one embodiment, a combination of casting and compression molding can be used to form a polyurethane or polyurea composition over an inner ball. However, the method of forming covers according to the invention is not limited to the use of these techniques; other methods known to those skilled in the art may also be employed.

While the compositions of the invention improve adhesion, prior to forming the cover layer, the inner ball, i.e., the core and any intermediate layers disposed thereon, may be surface treated to further increase the adhesion between the outer surface of the inner ball and the cover. In addition, when the outer cover layer is formed of the radiation-curable composition of the invention, the formed ball may be subjected to surface treatment so as to further increase the adhesion quality between the outer cover layer and the coating layer.

Examples of such surface treatment may include mechanically or chemically abrading the outer surface of the subassembly. Additionally, the inner ball may be subjected to corona discharge, plasma treatment, and/or silane dipping prior to forming the cover around it. Other layers of the ball, e.g., the core, also may be surface treated. Examples of these and other surface treatment techniques can be found in U.S. Pat. No. 6,315,915, which is incorporated by reference in its entirety.

The methods discussed herein and other manufacturing methods for forming the golf ball components of the present invention are also disclosed in U.S. Pat. Nos. 6,207,784 and 5,484,870, the disclosures of which are incorporated herein by reference in their entirety.

Dimples

The golf balls of the invention are prefereably designed with certain flight characteristics in mind. The use of various dimple patterns and profiles provides a relatively effective way to modify the aerodynamic characteristics of a golf ball. As such, the manner in which the dimples are arranged on the surface of the ball can be by any available method. For instance, the ball may have an icosahedron-based pattern, such as described in U.S. Pat. No. 4,560,168, or an octahedral-based dimple patterns as described in U.S. Pat. No. 4,960,281. Alternatively, the dimple pattern can be arranged according to phyllotactic patterns, such as described in U.S. Pat. No. 6,338,684, which is incorporated herein in its entirety. Dimple patterns may also be based on Archimedean patterns including a truncated octahedron, a great rhombcuboctahedron, a truncated dodecahedron, and a great rhombicosidodecahedron, wherein the pattern has a non-linear parting line, as disclosed in U.S. patent application Ser. No. 10/078,417, which is incorporated in its entirety by reference herein. The golf balls of the present invention may also be covered with non-circular shaped dimples, i.e., amorphous shaped dimples, as disclosed in U.S. Pat. No. 6,409,615, which is incorporated in its entirety by reference herein.

Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In one embodiment, the golf balls of the invention have a dimple coverage of the surface area of the cover of at least about 60 percent, preferably at least about 65 percent, and more preferably at least 70 percent or greater. Dimple patterns having even higher dimple coverage values may also be used with the present invention. Thus, the golf balls of the present invention may have a dimple coverage of at least about 75 percent or greater, about 80 percent or greater, or even about 85 percent or greater.

In addition, a tubular lattice pattern, such as the one disclosed in U.S. Pat. No. 6,290,615, which is incorporated by reference in its entirety herein, may also be used with golf balls of the present invention. The golf balls of the present invention may also have a plurality of pyramidal projections disposed on the intermediate layer of the ball, as disclosed in U.S. Pat. No. 6,383,092, which is incorporated in its entirety by reference herein. The plurality of pyramidal projections on the golf ball may cover between about 20 percent to about 80 of the surface of the intermediate layer.

In an alternative embodiment, the golf ball may have a non-planar parting line allowing for some of the plurality of pyramidal projections to be disposed about the equator. Such a golf ball may be fabricated using a mold as disclosed in U.S. patent application Ser. No. 09/442,845, filed Nov. 18, 1999, entitled "Mold For A Golf Ball," and which is incorporated in its entirety by reference herein. This embodiment allows for greater uniformity of the pyramidal projections. Several additional non-limiting examples of dimple patterns with varying sizes of dimples are also provided in U.S. Pat. Nos. 6,358,161 and 6,213,898, the entire disclosures of which are incorporated by reference herein.

The total number of dimples on the ball, or dimple count, may vary depending such factors as the sizes of the dimples and the pattern selected. In general, the total number of dimples on the ball preferably is between about 100 to about 1000 dimples, although one skilled in the art would recognize that differing dimple counts within this range can significantly alter the flight performance of the ball. In one embodiment, the dimple count is about 380 dimples or greater, but more preferably is about 400 dimples or greater, and even more preferably is about 420 dimples or greater. In one embodiment, the dimple count on the ball is about 422 dimples. In some cases, it may be desirable to have fewer dimples on the ball. Thus, one embodiment of the present invention has a dimple count of about 380 dimples or less, and more preferably is about 350 dimples or less.

Dimple profiles revolving a catenary curve about its symmetrical axis may increase aerodynamic efficiency, provide a convenient way to alter the dimples to adjust ball performance without changing the dimple pattern, and result in uniformly increased flight distance for golfers of all swing speeds. Thus, catenary curve dimple profiles, as disclosed in U.S. patent application Ser. No. 09/989,191, filed Nov. 21, 2001, entitled "Golf Ball Dimples with a Catenary Curve Profile," which is incorporated in its entirety by reference herein, is contemplated for use with the golf balls of the present invention.

Golf Ball Post-Processing

The golf balls of the present invention may be painted, coated, or surface treated for further benefits. For example, a golf ball of the invention may be treated with a base resin paint composition or the cover composition may contain certain additives to achieve a desired color characteristic. In one embodiment, the golf ball cover composition contains a fluorescent whitening agent, e.g., a derivative of 7-triazinylamino-3-phenylcoumarin, to provide improved weather resistance and brightness. An example of such a fluorescent whitening agent is disclosed in U.S. Patent Publication No. 2002/0082358, which is incorporated by reference herein in its entirety. Protective and decorative coating materials, as well as methods of applying such materials to the surface of a golf ball cover are well known in the golf ball art. Generally, such coating materials comprise urethanes, urethane hybrids, epoxies, polyesters and acrylics. If desired, more than one coating layer can be used. The coating layer(s) may be applied by any suitable method known to those of ordinary skill in the art. For example, the coating layer(s) may be applied to the golf ball cover by an in-mold coating process, such as described in U.S. Pat. No. 5,849,168, which is incorporated in its entirety by reference herein. The coating layer may have a thickness of about 0.004 inches or less, more preferably about 0.002 inches or less.

In addition, the golf balls of the invention may be painted or coated with an ultraviolet curable/treatable ink, by using the methods and materials disclosed in U.S. Pat. Nos. 6,500,495, 6,248,804, and 6,099,415, the entire disclosures of which are incorporated by reference herein.

In addition, trademarks or other indicia may be stamped, i.e., pad-printed, on the outer surface of the ball cover, and the stamped outer surface is then treated with at least one clear coat to give the ball a glossy finish and protect the indicia stamped on the cover.

The golf balls of the invention may also be subjected to dye sublimation, wherein at least one golf ball component is subjected to at least one sublimating ink that migrates at a depth into the outer surface and forms an indicia. The at least one sublimating ink preferably includes at least one of an azo dye, a nitroarylamine dye, or an anthraquinone dye. U.S. patent application Ser. No. 10/012,538, filed Dec. 12, 2001, entitled, "Method of Forming Indicia on a Golf Ball," the entire disclosure of which is incorporated by reference herein.

Laser marking of a selected surface portion of a golf ball causing the laser light-irradiated portion to change color is also contemplated for use with the present invention. U.S. Pat. Nos. 5,248,878 and 6,075,223 generally disclose such methods, the entire disclosures of which are incorporated by reference herein. In addition, the golf balls may be subjected to ablation, i.e., directing a beam of laser radiation onto a portion of the cover, irradiating the cover portion, wherein the irradiated cover portion is ablated to form a detectable mark, wherein no significant discoloration of the cover portion results therefrom. Ablation is discussed in U.S. Pat. No. 6,462,303, which is incorporated in its entirety by reference herein.

Golf Ball Properties

The properties such as hardness, modulus, core diameter, intermediate layer thickness and cover layer thickness of the golf balls of the present invention have been found to effect play characteristics such as spin, initial velocity and feel of the present golf balls. For example, the flexural and/or tensile modulus of the intermediate layer are believed to have an effect on the "feel" of the golf balls of the present invention. It should be understood that the ranges herein are meant to be intermixed with each other, i.e., the low end of one range may be combined with a high end of another range.

Component Dimensions

Dimensions of golf ball components, i.e., thickness and diameter, may vary depending on the desired properties. For the purposes of the invention, any layer thickness may be employed. Non-limiting examples of the various embodiments outlined above are provided here with respect to layer dimensions.

The present invention relates to golf balls of any size. While USGA specifications limit the size of a competition golf ball to more than 1.68 inches in diameter, golf balls of any size can be used for leisure golf play. The preferred diameter of the golf balls is from about 1.68 inches to about 1.8 inches. The more preferred diameter is from about 1.68 inches to about 1.76 inches. A diameter of from about 1.68 inches to about 1.74 inches is most preferred, however diameters anywhere in the range of from 1.7 to about 1.95 inches can be used. Preferably, the overall diameter of the core and all intermediate layers is about 80 percent to about 98 percent of the overall diameter of the finished ball.

The core may have a diameter ranging from about 0.09 inches to about 1.65 inches. In one embodiment, the diameter of the core of the present invention is about 1.2 inches to about 1.630 inches. In another embodiment, the diameter of the core is about 1.3 inches to about 1.6 inches, preferably from about 1.39 inches to about 1.6 inches, and more preferably from about 1.5 inches to about 1.6 inches. In yet another embodiment, the core has a diameter of about 1.55 inches to about 1.65 inches.

The core of the golf ball may also be extremely large in relation to the rest of the ball. For example, in one embodiment, the core makes up about 90 percent to about 98 percent of the ball, preferably about 94 percent to about 96 percent of the ball. In this embodiment, the diameter of the core is preferably about 1.54 inches or greater, preferably about 1.55 inches or greater. In one embodiment, the core diameter is about 1.59 inches or greater. In another embodiment, the diameter of the core is about 1.64 inches or less.

When the core includes an inner core layer and an outer core layer, the inner core layer is preferably about 0.09 inches or greater and the outer core layer preferably has a thickness of about 0.1 inches or greater. In one embodiment, the inner core layer has a diameter from about 0.09 inches to about 1.2 inches and the outer core layer has a thickness from about 0.1 inches to about 0.8 inches. In yet another embodiment, the inner core layer diameter is from about 0.095 inches to about 1.1 inches and the outer core layer has a thickness of about 0.20 inches to about 0.03 inches.

If the composition of the invention is used as an outer core layer, the cured thickness of the layer is preferably about 0.001 inches to about 0.1 inches. In one embodiment, the outer core layer's cured thickness is about 0.002 inches to about 0.05 inches. In another embodiment, the cured thickness of the outer core layer is about 0.003 inches to about 0.03 inches.

The cover typically has a thickness to provide sufficient strength, good performance characteristics, and durability. The thickness of the outer cover layer may be from about 0.005 inches to about 0.100 inches, preferably about 0.007 inches to about 0.035 inches. In one embodiment, the cover thickness is from about 0.02 inches to about 0.35 inches. In another embodiment, the cover preferably has a thickness of about 0.02 inches to about 0.12 inches, preferably about 0.1 inches or less, more preferably about 0.07 inches or less. In yet another embodiment, the outer cover has a thickness from about 0.02 inches to about 0.07 inches. In still another embodiment, the cover thickness is about 0.05 inches or less, preferably from about 0.02 inches to about 0.05 inches. For example, the outer cover layer may be between about 0.02 inches and about 0.045 inches, preferably about 0.025 inches to about 0.04 inches thick. In one embodiment, the outer cover layer is about 0.03 inches thick.

The range of thicknesses for an intermediate layer of a golf ball is large because of the vast possibilities when using an intermediate layer, i.e., as an outer core layer, an inner cover layer, a wound layer, a moisture/vapor barrier layer. When used in a golf ball of the invention, the intermediate layer, or inner cover layer, may have a thickness about 0.3 inches or less. In one embodiment, the thickness of the intermediate layer is from about 0.002 inches to about 0.1 inches, preferably about 0.01 inches or greater. In one embodiment, the thickness of the intermediate layer is about 0.09 inches or less, preferably about 0.06 inches or less. In another embodiment, the intermediate layer thickness is about 0.05 inches or less, more preferably about 0.01 inches to about 0.045 inches. In one embodiment, the intermediate layer, thickness is about 0.02 inches to about 0.04 inches. In another embodiment, the intermediate layer thickness is from about 0.025 inches to about 0.035 inches. In yet another embodiment, the thickness of the intermediate layer is about 0.035 inches thick. In still another embodiment, the inner cover layer is from about 0.03 inches to about 0.035 inches thick. Varying combinations of these ranges of thickness for the intermediate and outer cover layers may be used in combination with other embodiments described herein.

If the composition of the invention is used as an inner cover layer, for example, the cured thickness of the layer is preferably about 0.001 inches to about 0.1 inches. In one embodiment, the outer core layer's cured thickness is about 0.002 inches to about 0.05 inches. In another embodiment, the cured thickness of the outer core layer is about 0.003 inches to about 0.03 inches. If the composition of the invention is used as an outer cover layer, its cured thickness is preferably about 0.005 inches to about 0.100 inches, more preferably about 0.007 inches to about 0.035 inches.

The ratio of the thickness of the intermediate layer to the outer cover layer is preferably about 10 or less, preferably from about 3 or less. In another embodiment, the ratio of the thickness of the intermediate layer to the outer cover layer is about 1 or less.

The core and intermediate layer(s) together form an inner ball preferably having a diameter of about 1.48 inches or greater for a 1.68-inch ball. In one embodiment, the inner ball of a 1.68-inch ball has a diameter of about 1.52 inches or greater. In another embodiment, the inner ball of a 1.68-inch ball has a diameter of about 1.66 inches or less. In yet another embodiment, a 1.72-inch (or more) ball has an inner ball diameter of about 1.50 inches or greater. In still another embodiment, the diameter of the inner ball for a 1.72-inch ball is about 1.70 inches or less.

Hardness

Most golf balls consist of layers having different hardnesses, e.g., hardness gradients, to achieve desired performance characteristics. The present invention contemplates golf balls having hardness gradients between layers, as well as those golf balls with layers having the same hardness.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

The cores of the present invention may have varying hardnesses depending on the particular golf ball construction. In one embodiment, the core hardness is at least about 15 Shore A, preferably about 30 Shore A, as measured on a formed sphere. In another embodiment, the core has a hardness of about 50 Shore A to about 90 Shore D. In yet another embodiment, the hardness of the core is about 80 Shore D or less. Preferably, the core has a hardness about 30 to about 65 Shore D, and more preferably, the core has a hardness about 35 to about 60 Shore D.

The intermediate layer(s) of the present invention may also vary in hardness depending on the specific construction of the ball. In one embodiment, the hardness of the intermediate layer is about 30 Shore D or greater. In another embodiment, the hardness of the intermediate layer is about 90 Shore D or less, preferably about 80 Shore D or less, and more preferably about 70 Shore D or less. In yet another embodiment, the hardness of the intermediate layer is about 50 Shore D or greater, preferably about 55 Shore D or greater. In one embodiment, the intermediate layer hardness is from about 55 Shore D to about 65 Shore D. The intermediate layer may also be about 65 Shore D or greater.

When the intermediate layer is intended to be harder than the core layer, the ratio of the intermediate layer hardness to the core hardness preferably about 2 or less. In one embodiment, the ratio is about 1.8 or less. In yet another embodiment, the ratio is about 1.3 or less.

As with the core and intermediate layers, the cover hardness may vary depending on the construction and desired characteristics of the golf ball. The ratio of cover hardness to inner ball hardness is a primary variable used to control the aerodynamics of a ball and, in particular, the spin of a ball. In general, the harder the inner ball, the greater the driver spin and the softer the cover, the greater the driver spin.

For example, when the intermediate layer is intended to be the hardest point in the ball, e.g., about 50 Shore D to about 75 Shore D, the cover material may have a hardness of about 20 Shore D or greater, preferably about 25 Shore D or greater, and more preferably about 30 Shore D or greater, as measured on the slab. In another embodiment, the cover itself has a hardness of about 30 Shore D or greater. In particular, the cover may be from about 30 Shore D to about 70 Shore D. In one embodiment, the cover has a hardness of about 40 Shore D to about 65 Shore D, and in another embodiment, about 40 Shore to about 55 Shore D. In another aspect of the invention, the cover has a hardness less than about 45 Shore D, preferably less than about 40 Shore D, and more preferably about 25 Shore D to about 40 Shore D. In one embodiment, the cover has a hardness from about 30 Shore D to about 40 Shore D.

In this embodiment when the outer cover layer is softer than the intermediate layer or inner cover layer, the ratio of the Shore D hardness of the outer cover material to the intermediate layer material is about 0.8 or less, preferably about 0.75 or less, and more preferably about 0.7 or less. In another embodiment, the ratio is about 0.5 or less, preferably about 0.45 or less.

In yet another embodiment, the ratio is about 0.1 or less when the cover and intermediate layer materials have hardnesses that are substantially the same. When the hardness differential between the cover layer and the intermediate layer is not intended to be as significant, the cover may have a hardness of about 55 Shore D to about 65 Shore D. In this embodiment, the ratio of the Shore D hardness of the outer cover to the intermediate layer is about 1.0 or less, preferably about 0.9 or less.

The cover hardness may also be defined in terms of Shore C. For example, the cover may have a hardness of about 70 Shore C or greater, preferably about 80 Shore C or greater. In another embodiment, the cover has a hardness of about 95 Shore C or less, preferably about 90 Shore C or less.

In another embodiment, the cover layer is harder than the intermediate layer. In this design, the ratio of Shore D hardness of the cover layer to the intermediate layer is about 1.33 or less, preferably from about 1.14 or less.

When a two-piece ball is constructed, the core may be softer than the outer cover. For example, the core hardness may range from about 30 Shore D to about 50 Shore D, and the cover hardness may be from about 50 Shore D to about 80 Shore D. In this type of construction, the ratio between the cover hardness and the core hardness is preferably about 1.75 or less. In another embodiment, the ratio is about 1.55 or less. Depending on the materials, for example, if a composition of the invention is acid-functionalized wherein the acid groups are at least partially neutralized, the hardness ratio of the cover to core is preferably about 1.25 or less.

Compression

Compression values are dependent on the diameter of the component being measured. Atti compression is typically used to measure the compression of a golf ball. As used herein, the terms "Atti compression" or "compression" are defined as the deflection of an object or material relative to the deflection of a calibrated spring, as measured with an Atti Compression Gauge, that is commercially available from Atti Engineering Corp. of Union City, N.J.

The Atti compression of the core, or portion of the core, of golf balls prepared according to the invention is preferably less than about 80, more preferably less than about 75. In another embodiment, the core compression is from about 40 to about 80, preferably from about 50 to about 70. In yet another embodiment, the core compression is preferably below about 50, and more preferably below about 25. In an alternative, low compression embodiment, the core has a compression less than about 20, more preferably less than about 10, and most preferably, 0. As known to those of ordinary skill in the art, however, the cores generated according to the present invention may be below the measurement of the Atti Compression Gauge.

In one embodiment, golf balls of the invention preferably have an Atti compression of about 55 or greater, preferably from about 60 to about 120. In another embodiment, the Atti compression of the golf balls of the invention is at least about 40, preferably from about 50 to 120, and more preferably from about 60 to 100. In yet another embodiment, the compression of the golf balls of the invention is about 75 or greater and about 95 or less. For example, a preferred golf ball of the invention may have a compression from about 80 to about 95.

Initial Velocity and COR

There is currently no USGA limit on the COR of a golf ball, but the initial velocity of the golf ball cannot exceed 250±5 feet/second (ft/s). Thus, in one embodiment, the initial velocity is about 245 ft/s or greater and about 255 ft/s or greater. In another embodiment, the initial velocity is about 250 ft/s or greater. In one embodiment, the initial velocity is about 253 ft/s to about 254 ft/s. In yet another embodiment, the initial velocity is about 255 ft/s. While the current rules on initial velocity require that golf ball manufacturers stay within the limit, one of ordinary skill in the art would appreciate that the golf ball of the invention would readily convert into a golf ball with initial velocity outside of this range. For example, a golf ball of the invention may be designed to have an initial velocity of about 220 ft/s or greater, preferably about 225 ft/s or greater.

As a result, of the initial velocity limitation set forth by the USGA, the goal is to maximize COR without violating the 255 ft/s limit. The COR of a ball is measured by taking the ratio of the outbound or rebound velocity to the incoming or inbound velocity. In a one-piece solid golf ball, the COR will depend on a variety of characteristics of the ball, including its composition and hardness. For a given composition, COR will generally increase as hardness is increased. In a two-piece solid golf ball, e.g., a core and a cover, one of the purposes of the cover is to produce a gain in COR over that of the core. When the contribution of the core to high COR is substantial, a lesser contribution is required from the cover. Similarly, when the cover contributes substantially to high COR of the ball, a lesser contribution is needed from the core.

The present invention contemplates golf balls having CORs from about 0.700 to about 0.850 at an inbound velocity of about 125 ft/sec. In one embodiment, the COR is about 0.750 or greater, preferably about 0.780 or greater. In another embodiment, the ball has a COR of about 0.800 or greater. In yet another embodiment, the COR of the balls of the invention is about 0.800 to about 0.815.

In addition, the inner ball preferably has a COR of about 0.780 or more. In one embodiment, the COR is about 0.790 or greater.

Spin Rate

As known to those of ordinary skill in the art, the spin rate of a golf ball will vary depending on the golf ball construction. In a multilayer ball, e.g., a core, an intermediate layer, and a cover, wherein the cover is formed from the polyurea or polyurethane compositions of the invention, the spin rate of the ball off a driver ("driver spin rate") may be 1500 rpm or greater. In one embodiment, the driver spin rate is about 2000 rpm to about 3500 rpm. In another embodiment, the driver spin rate is about 2200 rpm to about 3400 rpm. In still another embodiment, the driver spin rate may be less than about 1500 rpm.

Two-piece balls made according to the invention may also have driver spin rates of 1500 rpm and greater. In one embodiment, the driver spin rate is about 2000 rpm to about 3300 rpm. Wound balls made according to the invention preferably have similar spin rates.

Methods of determining the spin rate should be well understood by those of ordinary skill in the art. Examples of methods for determining the spin rate are disclosed in U.S. Pat. Nos. 6,500,073, 6,488,591, 6,286,364, and 6,241,622, which are incorporated by reference herein in their entirety.

Flexural Modulus

Accordingly, it is preferable that the golf balls of the present invention have an intermediate layer with a flexural modulus of about 500 psi to about 500,000 psi according to ASTM D-6272-98. More preferably, the flexural modulus of the intermediate layer is about 1,000 psi to about 250,000 psi. Most preferably, the flexural modulus of the intermediate layer is about 2,000 psi to about 200,000 psi.

The flexural modulus of the cover layer is preferably about 2,000 psi or greater, and more preferably about 5,000 psi or greater. In one embodiment, the flexural modulus of the cover is from about 10,000 psi to about 150,000 psi. More preferably, the flexural modulus of the cover layer is about 15,000 psi to about 120,000 psi. Most preferably, the flexural modulus of the cover layer is about 18,000 psi to about 110,000 psi. In another embodiment, the flexural modulus of the cover layer is about 100,000 psi or less, preferably about 80,000 or less, and more preferably about 70,000 psi or less. For example, the flexural modulus of the cover layer may be from about 10,000 psi to about 70,000 psi, from about 12,000 psi to about 60,000 psi, or from about 14,000 psi to about 50,000 psi.

In one embodiment, when the cover layer has a hardness of about 50 Shore D to about 60 Shore D, the cover layer preferably has a flexural modulus of about 55,000 psi to about 65,000 psi.

In one embodiment, the ratio of the flexural modulus of the intermediate layer to the cover layer is about 0.003 to about 50. In another embodiment, the ratio of the flexural modulus of the intermediate layer to the cover layer is about 0.006 to about 4.5. In yet another embodiment, the ratio of the flexural modulus of the intermediate layer to the cover layer is about 0.11 to about 4.5.

In one embodiment, the compositions of the invention are used in a golf ball with multiple cover layers having essentially the same hardness, but differences in flexural moduli. In this aspect of the invention, the difference between the flexural moduli of the two cover layers is preferably about 5,000 psi or less. In another embodiment, the difference in flexural moduli is about 500 psi or greater. In yet another embodiment, the difference in the flexural moduli between the two cover layers, wherein at least one is reinforced is about 500 psi to about 10,000 psi, preferably from about 500 psi to about 5,000 psi. In one embodiment, the difference in flexural moduli between the two cover layers formed of unreinforced or unmodified materials is about 1,000 psi to about 2,500 psi.

Specific Gravity

The specific gravity of a cover or intermediate layer is preferably at least about 0.7. In one embodiment, the specific gravity of the intermediate layer or cover is about 0.8 or greater, preferably about 0.9 or greater. For example, in one embodiment, the golf ball has an intermediate layer with a specific gravity of about 0.9 or greater and a cover having a specific gravity of about 0.95 or greater. In another embodiment, the intermediate layer or cover has a specific gravoty of about 1.00 or greater. In yet another embodiment, the specific gravity of the intermediate layer or cover is about 1.05 or greater, preferably about 1.10 or greater.

The core may have a specific gravity of about 1.00 or greater, preferably 1.05 or greater. For example, a golf ball of the invention may have a core with a specific gravity of about 1.10 or greater and a cover with a specific gravity of about 0.95 or greater.

While it is apparent that the invention disclosed herein is well calculated to fulfill the objects stated above, it will be appreciated that numerous modifications and embodiments may be devised by those skilled in the art. For example, while golf balls and golf ball components are used as examples for articles incorporating the compositions of the invention, other golf equipment may be formed from the compositions of the invention. In one embodiment, at least a portion of a golf shoe is formed from the composition of the invention. In another embodiment, the composition of the invention is used to form at least a portion of a golf club, e.g., a putter insert. Therefore, it is intended that the appended claims cover all such modifications and embodiments that fall within the true spirit and scope of the present invention.

We claim:

1. A golf ball comprising:

a core;

a cover; and an intermediate layer having a continuous inner perimeter surrounding the core and a continuous outer perimeter surrounded by the cover, wherein the entire intermediate layer is formed from a radiation-curable composition comprising:

a polymer component having at least one ultraviolet-light curable moiety; and a photoinitiator.

2. The golf ball of claim 1, wherein the radiation-curable composition further comprises a visible light initiator.

3. The golf ball of claim 1, wherein the polymer component is present in the composition in an amount of about 50 percent to about 99 percent by weight of the composition.

4. The golf ball of claim 1, wherein the photoinitiator is present in an amount of about 0.05 percent to about 15 percent by weight of the composition.

5. The golf ball of claim 1, wherein the cover comprises a polyurethane, a polyurea, or a mixture thereof.

6. The golf ball of claim 1, wherein the intermediate layer further comprises at least one multifunctional acrylic or methacrylic crosslinking agent.

7. The golf ball of claim 1, wherein the intermediate layer further comprises at least one reactive diluent.

8. The golf ball of claim 1, wherein the intermediate layer further comprises at least one elongation promoter.

9. The golf ball of claim 1, wherein the cover comprises an inner cover and an outer cover, and wherein the continuous outer perimeter of the intermediate layer is surrounded by the inner cover.

10. A golf ball comprising a core and a cover disposed about the core, wherein at least one structural layer of the core is formed in its entirety from a radiation-curable composition comprising:

a polymer component having at least one ultraviolet-light curable moiety; and a photoinitiator.

11. The golf ball of claim 10, wherein the dry peel strength is about 0.5 pound per linear inch or greater.

12. The golf ball of claim 10, wherein the wet peel strength is about 0.25 pounds per linear inch or greater.

13. The golf ball of claim 10, wherein the core comprises an inner core layer and an outer core layer, and wherein the at least one layer is an outer core layer.

14. The golf ball of claim 10, wherein the at least one layer has a thickness of between about 0.001 inches and about 0.1 inches.

15. A golf ball comprising an inner ball and a cover disposed about the inner ball, wherein at least one continuous layer of the inner ball is formed in its entirety from a radiation-curable composition comprising a polymer component having at least one ultraviolet-light curable moiety; and an photoinitiator, and wherein the at least one layer has a thickness between about 0.01 inches or greater.

16. The golf ball of claim 15, wherein the radiation-curable composition further comprises at least one visible light initiator.

17. The golf ball of claim 15, wherein the polymer component is present in the composition in an amount of about 20 percent to about 80 percent by weight of the composition.

18. The golf ball of claim 15, wherein the photoinitiator is present in an amount of about 0.05 percent to about 15 percent by weight of the composition.

19. The golf ball of claim 15, wherein the inner ball comprises a center and an outer core layer disposed about the center, and wherein the at least one layer is the outer core layer.

20. The golf ball of claim 15, wherein the inner ball comprises a core and an intermediate layer disposed about the core, and wherein the at least one layer is an intermediate layer.

* * * * *